US009675141B2

(12) United States Patent
Wikner et al.

(10) Patent No.: US 9,675,141 B2
(45) Date of Patent: Jun. 13, 2017

(54) SAFETY BUCKLE DEVICE

(71) Applicant: BabyBjorn AB, Solna (SE)

(72) Inventors: Jakob Wikner, Taby (SE); Thomas Bergens, Ingaro (SE); Marten Andren, Spanga (SE)

(73) Assignee: BABYBJORN AB, Solna (SE)

( * ) Notice: Subject to any disclaimer, the term of this patent is extended or adjusted under 35 U.S.C. 154(b) by 165 days.

(21) Appl. No.: 14/414,179

(22) PCT Filed: Jul. 3, 2013

(86) PCT No.: PCT/SE2013/050861

§ 371 (c)(1),
(2) Date: Jan. 12, 2015

(87) PCT Pub. No.: WO2014/011104

PCT Pub. Date: Jan. 16, 2014

(65) Prior Publication Data

US 2015/0181984 A1 Jul. 2, 2015

(30) Foreign Application Priority Data

Jul. 12, 2012 (SE) ..... 1250818

(51) Int. Cl.
*A44B 11/25* (2006.01)
*A47D 13/02* (2006.01)

(52) U.S. Cl.
CPC ..... *A44B 11/2503* (2013.01); *A44B 11/2515* (2013.01); *A44B 11/2534* (2013.01); *A44B 11/2546* (2013.01); *A44B 11/2573* (2013.01); *A47D 13/02* (2013.01); *Y10T 24/45524* (2015.01); *Y10T 24/45529* (2015.01)

(58) Field of Classification Search
CPC ..... Y10T 24/45529; Y10T 24/45534; Y10T 24/45524; A44B 11/2573; A44B 11/2515; A44B 11/2503; A44B 11/2534; A47D 13/02
See application file for complete search history.

(56) References Cited

U.S. PATENT DOCUMENTS 5,355,562 A * 10/1994 Matoba ..... A44B 11/266 24/615
6,931,695 B2 * 8/2005 Anscher ..... A44B 11/2549 24/614
7,340,809 B2 * 3/2008 Tracy ..... B60N 2/2812 200/61.58 B (Continued)

*Primary Examiner* — Robert J Sandy
(74) *Attorney, Agent, or Firm* — Jacobson Holman, PLLC.

(57) ABSTRACT

A safety buckle device includes a first buckle part having a partially closed space with an opening, and a second buckle part having a body, a guiding tongue, and a control key. When locking the safety buckle device, a springing detent is adapted to lock against a locking element. The control key has two recesses having different depths and arranged adjacent each other in the longitudinal direction of the control key. The detent achieves a first locking when the control key is actuated, and the detent achieves a second locking when the control key no longer is actuated, or the detent achieves a locking when the control key is not actuated. The detent is adapted to be released when the control key is actuated again, or when the control key is actuated.

14 Claims, 5 Drawing Sheets

(56) References Cited

U.S. PATENT DOCUMENTS

| | | | | |
|---|---|---|---|---|
| 7,725,993 | B1 * | 6/2010 | Giampavolo | A44B 11/266 24/614 |
| 8,677,575 | B1 * | 3/2014 | Bergstrom | A44C 5/2052 24/615 |
| 2011/0271499 | A1 * | 11/2011 | Parisi | A44B 11/263 24/615 |

* cited by examiner

SAFETY BUCKLE DEVICE

CROSS-REFERENCE TO RELATED APPLICATION

This application is a nationalization of PCT/SE2013/50861, filed Jul. 3, 2013.

BACKGROUND OF THE INVENTION

1. Field of Invention

The present invention relates to a safety buckle device of the kind defined in the preamble of the accompanying claim 1, and more particularly to a safety buckle device having two buckle parts which always lock to each other independently if the control key for opening the safety buckle device is actuated or not, and to a use of such a safety buckle device according to claim 12.

2. Description of the Prior Art

At a type of known baby carriers the baby carrier comprises strap loops intended to be carried around respective shoulder region of a wearer. A front piece is connected to and carried by the strap loops and preferably also by a waist belt. Each strap loop is connected on one hand to an upper portion of the front piece and on the other hand to a middle portion of the front piece. The connection of the strap loop with a front piece is usually made by some type of separable buckle device, i.e. the buckle device comprises two buckle parts, whereby one buckle part is connected to the front piece and the other buckle part is connected to the strap loop.

For instance, in the case the strap loop is connected by the separable buckle device to the front piece and more particularly to the middle portion of the front piece and on its front side, as seen when a child is carried on the chest side of the wearer, it is an advantage if the two buckle parts always lock to each other even when the control key for opening of the buckle device is actuated. The reason for this is that the buckle devices at the middle portion of the front piece carry a large portion of the weight of the child.

Furthermore, it is an advantage if the wearer receives on one hand an acoustic indication, a click sound, for instance, when the buckle device locks, and on the other hand that the buckle device has such a construction that every type of locking in an incorrect way will be avoided. This is particularly important when the buckle device is of the hook lock type, whereby the buckle device connected to the strap loop may for instance hook to and fasten to a portion of the baby carrier. The wearer may then by mistake be deluded into believing that he/she has hooked and locked the buckle device in the right way. The reason for this may be that the buckle device is possibly not seen by the wearer.

SUMMARY OF THE INVENTION

One object of the invention is to achieve a safety buckle device at which the two buckle parts will always lock to each other even when the control key is actuated/pressed in for opening of the safety buckle device.

A further object of the invention is to achieve a safety buckle device at which, when the two buckle parts are locked to each other, at least one acoustic indication is achieved.

These objects are achieved according to the invention by providing a safety buckle device comprising a first buckle part comprising an at least partially closed space having an opening, and a second buckle part comprising a body, a guiding tongue arranged to the body, and a control key, characterized in that, when locking the safety buckle device, the guiding tongue is adapted to be contained in said at least partially closed space, that a springing detent, which is arranged in said at least partially closed space is adapted to lock against a locking means which forms a part of the guiding tongue, the control key being formed with two recesses having different depths and arranged adjacent each other in the longitudinal direction of the control key, i) that the detent is adapted to achieve a first locking together with the locking means even when the control key is actuated, and the detent is adapted to achieve a second locking together with the locking means, when the control key no longer is actuated, or ii) that the detent is adapted to achieve a locking together with the locking means, when the control key is not actuated, and that the detent is adapted to be released from engagement with the locking means when in the case i) the control key is actuated again or when in the case ii) the control key is actuated.

Preferred embodiments are defined in the appending dependent claims.

BRIEF DESCRIPTION OF THE DRAWINGS

The invention is described in more detail below in the form of non-limited examples, reference being made to the appended drawings, in which FIG. 3*a* is a schematical view seen from behind of the second buckle part with the control key not actuated/pressed in, FIG. 3*b* is a view corresponding to the one in FIG. 3*a* but with the control key actuated/pressed in.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

In the description below, a first embodiment of a safety buckle device according to the invention for connecting a strap loop to a front piece of a baby carrier is described. In the second embodiment of the safety buckle device according to the invention the safety buckle device may be used for connecting both end portions of a strap, for instance, to each other for obtaining a closed loop. It is obvious for the man skilled in the art that the safety buckle device according to the invention can be used for connecting other parts than the above described.

Figure 1:
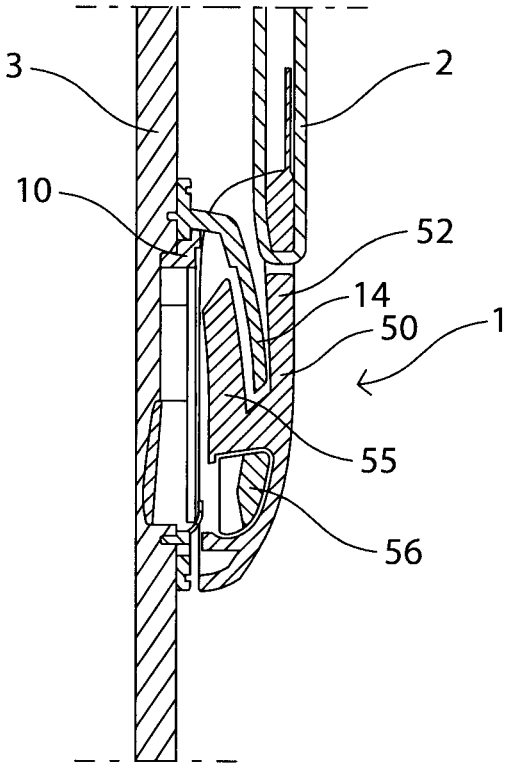
FIG. 1 is a schematical sectional side view of a first embodiment of a separable safety buckle device according to the invention, a first buckle part being attached to a schematically shown front piece of a baby carrier and a second buckle part being attached to a schematically shown strap loop.
Figure 2:
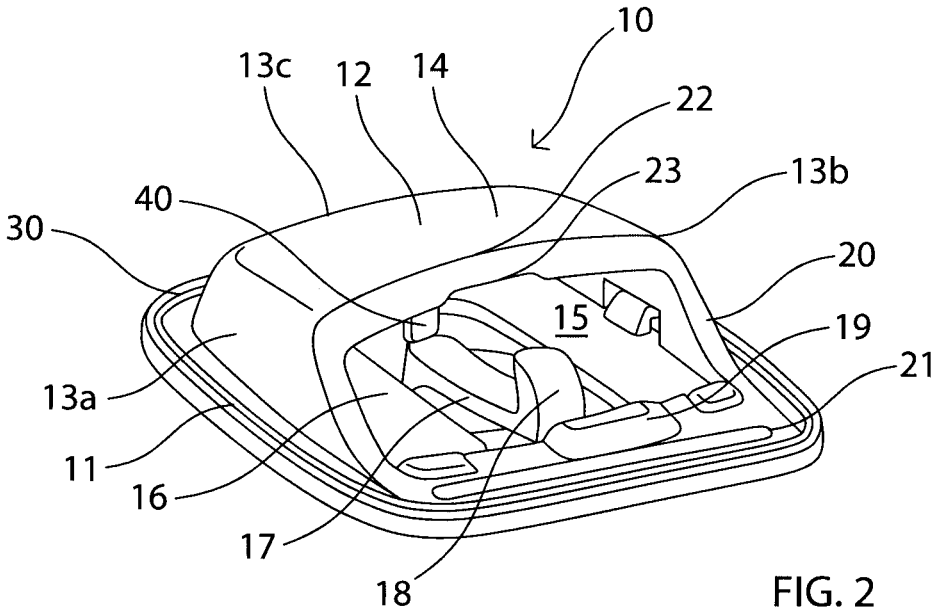
FIG. 2 is a schematical view seen obliquely from above of the first buckle part.

As is seen in FIGS. 1 and 2 a first embodiment of a separable safety buckle device 1 according to the invention comprises two to each other connectable buckle parts, a first buckle part 10 and a second buckle part 50. The first buckle part 10 is attached to a schematically shown front piece 3 of a baby carrier (not shown), and the second buckle part 50 is attached to a schematically shown strap loop 2 of said baby carrier.

The first buckle part 10 comprises a detent 17 which is springing both vertically and horizontally and which is fixedly connected with the first buckle part and intended to, in the locked position of the safety buckle device, to come into engagement with a locking means of the second buckle part 50. The first buckle part 10 forms a housing comprising a mounting plate 11 and a yoke 12 arranged on the mounting plate. The yoke 12 comprises two side walls 13*a*,13*b*, an end wall 13*c* and a yoke part 14 so as to form an at least partially closed space 15 inside the housing having an opening 16. The springing detent 17 is arranged in the at least partially closed space 15. The end of the detent 17 opposite to the hook 18 itself is preferably attached to the mounting plate 11. The hook 18 can be provided with a tongue 18*a* (FIG. 8) adapted to run in a notch 19 in the mounting plate 11. This tongue is adapted to limit the movement of the detent horizontally and vertically, respectively.

Moreover, the mounting plate 11 is provided with a recess 21 through which a strap or corresponding means, for instance, is adapted to be threaded for fastening the same at the first buckle part 10. The mounting plate 11 may also be provided with a stitch border 30 for stitching of the first buckle part to a strap/substrate.

Figure 7A:
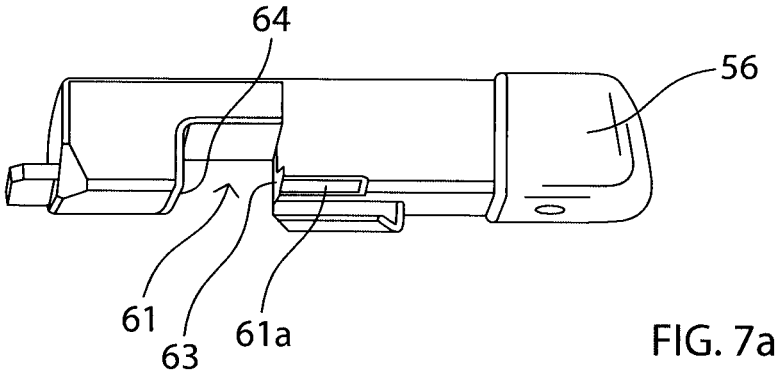
FIG. 7*a* is a side view in perspective of the control key rotated about 90° relative to the position of the control key as seen in FIGS. 3*a* and 3*b*.

From the first embodiment of the second buckle part 50, shown in FIGS. 3*a*-5, it is seen that the second buckle part comprises an essentially cup-shaped body 51 having a main part 52 and two side walls 53*a*,53*b*, an end wall 53*c* and an open portion 54, a guiding tongue 55 being arranged to extend from the end wall 53*c* towards the open portion 54. A spring biased control key 56 for actuating the detent 17 so as to open the safety buckle device is arranged in connection with the end wall 53*c* and has the shape of an elongated bar having recesses 61,61*a* (FIG. 7*a*). The safety buckle device is formed in such a way that when the control key is pressed in it is possible to open the buckle device.

In the first embodiment of the second buckle part 50 the guiding tongue 55 is arranged essentially in parallel with the main body 52. Between at least a portion of the guiding tongue 55 and the main portion 52 there is a space 57, in which at least a front portion 22 (FIG. 2) of the yoke 14 of the first buckle part 10 is adapted to be accommodated at the locked position of the safety buckle device.

Figure 4:
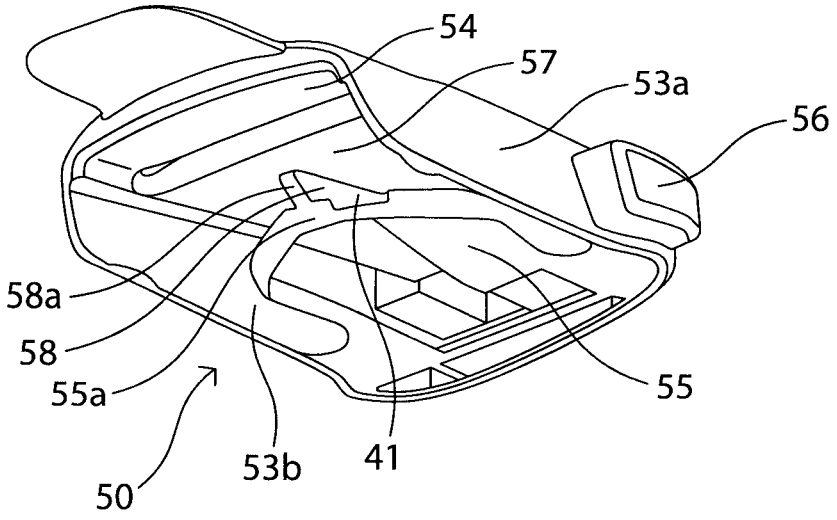
FIG. 4 is a schematical view seen obliquely from the front and behind of the second buckle part.
Figure 5:
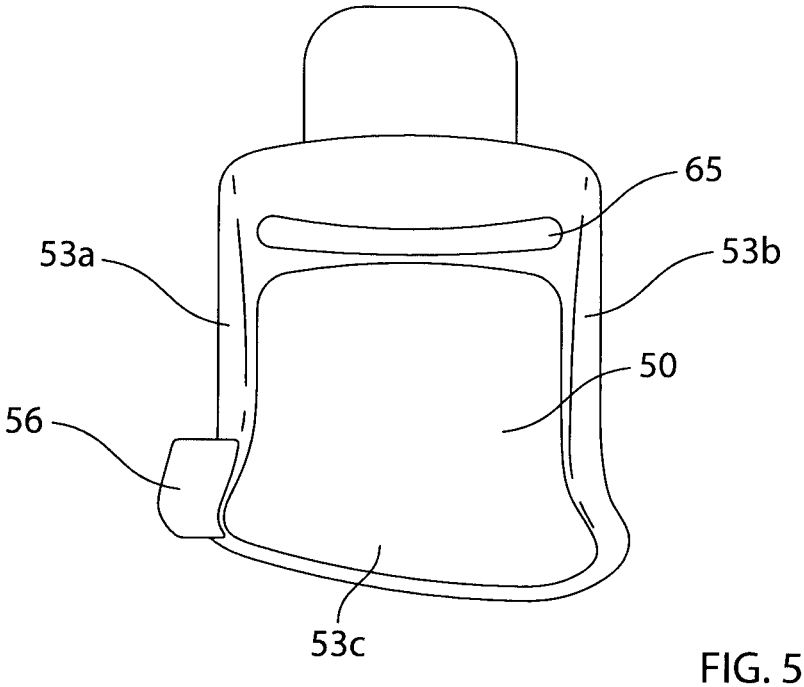
FIG. 5 is a schematical view seen from the front of the safety buckle device in FIG. 1.

As is seen in FIG. 4 the underside of the guiding tongue 55 is preferably placed at the same level as the edges of respective side walls 53*a*,53*b*, so as to prevent the guiding tongue to, by mistake, hook into any part of the baby carrier, for instance, which it is not intended for.

Preferably, a ridge 58 is arranged along essentially the whole length of the guiding tongue 55 and is directed towards the main part 52. A portion 58*a* of the ridge 58 protrudes in front of a front end 55*a* of the guiding tongue. The portion 58*a* of the ridge is intended for achieving an initial engagement with the yoke part 14 of the first buckle part when locking the safety buckle device. The yoke of the first buckle part, which has contact with the ridge 58, is preferably provided with a recess 23 (FIG. 2) complementary to the ridge 58.

Furthermore, as is seen in FIG. 1, particularly the inside of the main part 52 of the second buckle part 50 is arranged to snuggle abut against at least the front part 22 of the yoke part 14 of the first buckle part 10.

During insertion of the guiding tongue 55 into the opening 16 the side walls 53*a*,53*b* of the cup-shaped body 51 and the side walls 13*a*,13*b* of the yoke 12 are adapted to cooperate so as to achieve a suitable guiding between the two buckle parts and to have a certain clearance between each other. The side walls 53,53*b* are adapted to be placed over the side walls 13*a*,13*b*. In this way the inserting of the guiding tongue 55 into the opening 16 is facilitated. Also by shaping the side edges 20 of the opening 16 of the yoke 12 inclined and by shape the front end 55*a* of the guiding tongue 55 curved will result in that the guiding tongue can only be inserted into the opening at a relatively small angle. In a preferred embodiment this angle, between the main direction of guiding tongue 55 and the main direction of the opening 16, is about ±15°. This means that in the case the insertion angle between the guiding tongue 55 and the opening 16 is outside said angle range the guiding tongue will always slide pass the opening, i.e. the safety buckle device will thus not allow that any half-locked position may arise between the first and the second buckle parts 10,50, and it is only when the guiding tongue 55 and the opening 16 of the first buckle part 10 have been placed in the correct angle range relative to each other and they being exposed to an external force, which presses the two parts towards each other, the two buckle parts 10,50 can lock to each other.

Figure 7B:
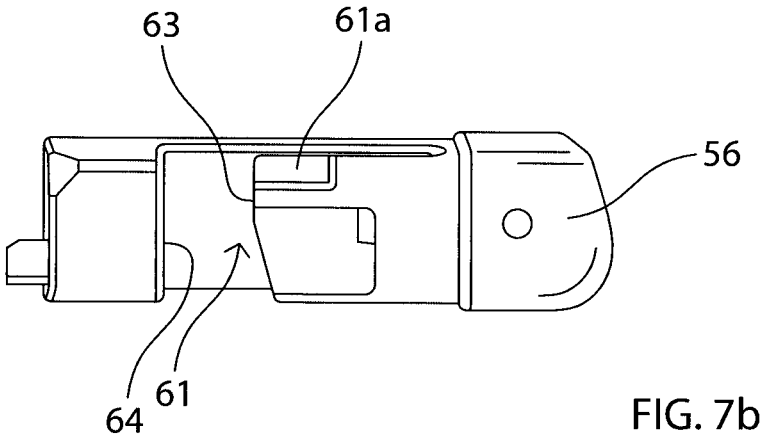
FIG. 7*b* is a side view of the control key in the same position as in FIGS. 3*a* and 3*b*.

The control key 56 is preferably shaped as an elongated bar having two recesses 61,61*a* with different depths and arranged adjacent to each other, see FIGS. 7*a* and 7*b*. During inserting the guiding tongue 55 into the opening 16, the hook 18 of the detent 17 is adapted to slidingly abut and to be springy biased against a first cut 60 in the guiding tongue 55 until the guiding tongue reaches the innermost position in the housing, in which position the hook 18 is adapted to springy be inserted into the recess 61 in the control key and to lock against a locking means 62, which in the shown embodiments is made in a form of a locking surface 62 and which forms a part of the guiding tongue 55. When the hook 18 is springy inserted into the recess 61 an acoustic indication arises, a click sound, for instance, which confirms that the safety buckle device has been locked in the correct way. In this position the hook is enclosed between an abutment surface 63 and a limiting surface 64 placed on each side of the recess 61.

Figure 3A:
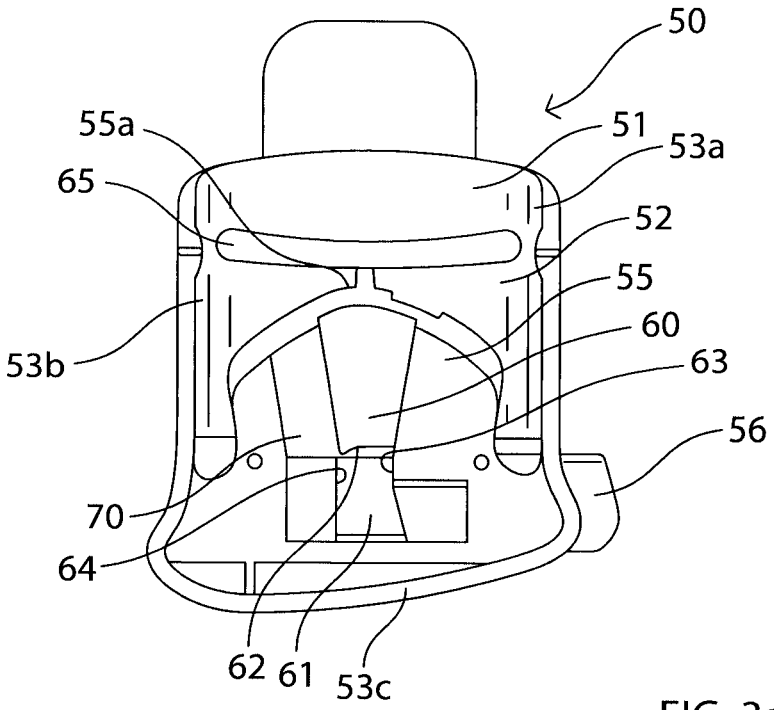
Figure 3B:
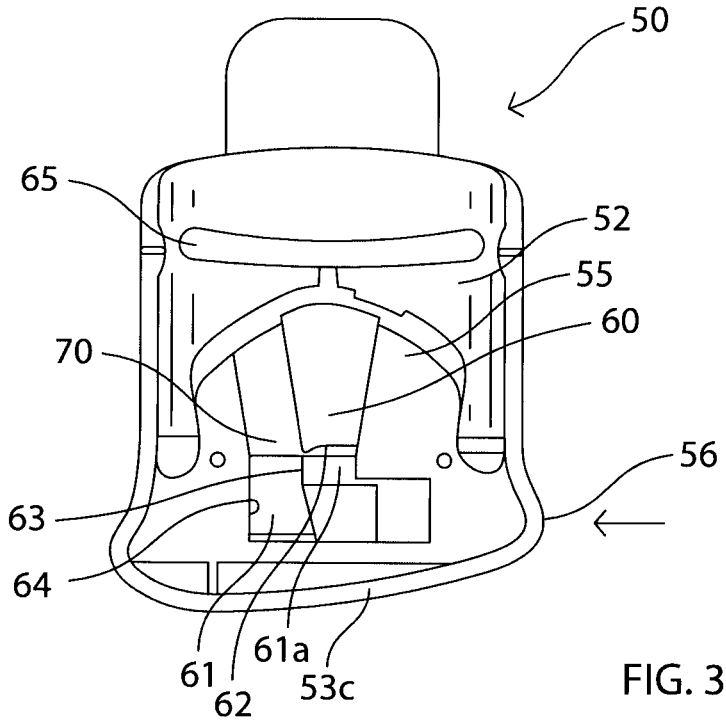

When unlocking the safety buckle device the control key is actuated by pressing the control key inwardly, i.e. the control key is displaced laterally in the direction of the arrow as seen in FIG. 3*b*, the abutment surface 63, which can be a wall of the recess 61, being arranged to displace, as seen to the left in FIGS. 3*a* and 3*b*, the hook 18 of the detent 17 laterally until the hook reaches a second cut 70 which is, relatively to the first cut 60, deeper, said cut 70 being provided in the guiding tongue 55. The second cut 70 does not have any locking surface. In this way the hook goes free from and does not anymore abut against the locking surface 62. In this laterally displaced position of the detent the two buckle parts can be separated from each other. A bottom surface of the second cut is preferably formed inclined so that its deepest part is placed in line with the locking surface 62 and being progressively shallower towards the front edge of the guiding tongue 55.

In a preferably preferred embodiment, in the actuated position of the control key 56, as shown in FIG. 3*b*, a somewhat shallower recess 61*a* than the recess 61 is arranged in the bar of the control key and adapted to be in line with the detent. This shallower recess allows, in the innermost position of the guiding tongue 55 in the housing, the hook 18 of the detent 17 to be springy inserted into this shallower recess 61*a* and lock against the locking surface 62, however, with somewhat less locking surface of the hook, i.e. a first locking is achieved, whereby also in this position an acoustic indication will arise which confirms that the safety buckle device has been locked. When, in this position, the control key is no longer actuated the control key will move to the right and thus return to its unaffected position, as seen in FIG. 3*a*, and the hook 18 will fully be inserted into the recess 61, whereby a second locking is achieved and a further acoustic indication arises. That is, in the case the control key is deliberately or unintentionally actuated two acoustic indications will arise when locking the two buckle parts to each other, i.e. a first when the hook 18 is springy inserted into the shallower recess 61*a* and a second when the hook is springy inserted into the recess 61 when the control key moves laterally. In both cases the hook 18 will lock against the same locking surface 62.

Furthermore, the body 51 of the second buckle part 50 is provided with a slot 65 through which a strap or a corresponding means, for instance, is intended to be threaded.

As seen in FIG. 1, the front side of the yoke part 14 of the first buckle part 10 with associated side edges 13*a*,13*b* is, in the locked position of the safety buckle device, adapted to closely abut against a lower side of the main portion 52 of the second buckle part 50 with associated side edges 53*a*, 53*b*. By constructing the safety buckle device in this way it is achieved that, when locking the safety buckle device, no undesired material, such as any loose fabric etc., may get jammed between the two buckle parts.

Furthermore, the first embodiment of the safety buckle device, as seen in FIGS. 1-5, can be shaped so as to achieve a right and a left buckle, respectively, i.e. a type of keying which does not allow the first buckle part of the left buckle device to be inserted into and locked to the second buckle part of the right buckle device and vice versa. For this object a protruding shoulder 40 (FIG. 2) may be arranged on the inside of the yoke 12 and directed towards the space 15 and adapted to fit into and cooperate with a complementary recess 41 (FIG. 4) arranged in the part of guiding tongue 55 which is directed towards the space 57.

Figure 6:
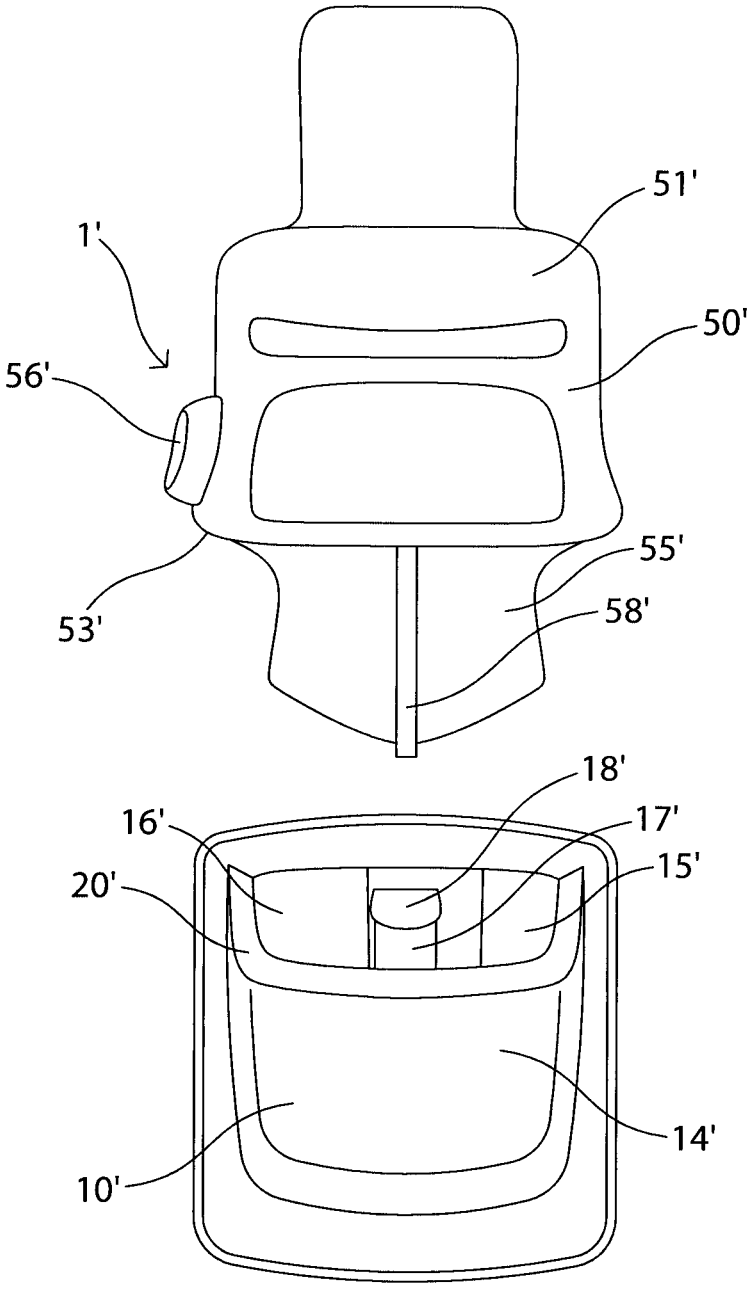
FIG. 6 is a schematical view of a second embodiment of a separable safety buckle device according to the invention with the buckle parts separated.

In the second embodiment of a safety buckle device 1' according to the invention, as seen in FIG. 6, the safety buckle device comprises two connectable buckle parts, a first buckle part 10' and a second buckle part 50'. The first buckle part 10' may be constructed identical to the first buckle part 10 of the first embodiment.

The differences between the second buckle part 50' of the second embodiment and the second buckle part 50 of the first embodiment is that the guiding tongue 55' has been rotated 180° in the plane of the buckle device, so that instead of being placed under the main portion 52 the guiding tongue protrudes from the end wall 53*c'*.

The locking of the safety buckle device is made in the same way in both embodiments and the locking between the two buckle parts will always be achieved independently of the control key 56' being actuated or not, and one or two acoustic indications will always arise independently of the position of the control key 56'.

Since the guiding tongue 55' is protruding from the end wall 53*c'*, the side walls 53*a*, 53*b* of the first embodiment has no guiding function, whereby this portion of the buckle part 50' can be made in a closed and ergonomically suitable way (not shown). This means that the entire guiding, when locking the two buckle parts to each other, is achieved by the guiding tongue 55' when it is inserted into the opening 16' in the housing.

Also in this embodiment the side edges of the wall 53*c'* has preferably a complementary shape to the side edges 20' of the opening 16'.

Figure 8:
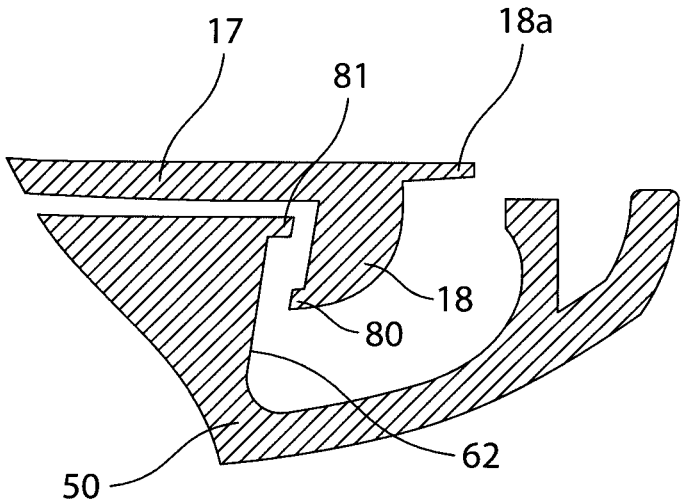
FIG. 8 is an enlarged, sectional, partial side view of the second buckle part and the detent.

To improve the locking between the detent 17 and the locking means 62, at least in an initial locking position between the first buckle part 10 and the second buckle part 50, the hook 18 of the detent 17 is, in a preferred embodiment, as shown in FIG. 8, provided with a shoulder 80 which is directed towards and adapted to cooperate with a complementary shoulder 81 of the locking means 62, which shoulder 81 is directed towards the hook, and the shoulder 80 is directed towards the locking surface 62.

The invention being thus described, it will be apparent that the same may be varied in many ways. such variations are not to be regarded as a departure from the spirit and scope of the invention, and all such modifications as would be recognized by one skilled in the art intended to be included within the scope of the following claims.

What is claimed is:

1. A safety buckle device comprising:

a first buckle part including an at least partially closed space having an opening; and a second buckle part including a body, a guiding tongue arranged to the body, and a control key, configured such that, when locking the safety buckle device, the guiding tongue is adapted to be contained in said at least partially closed space, and that a springing detent, which is arranged in said at least partially closed space, is adapted to lock against a locking element which forms a part of the guiding tongue, with a control key being formed with two recesses having different depths and arranged adjacent each other in a longitudinal direction of the control key, i) the detent being adapted to achieve a first locking together with the locking element when the control key is actuated, and the detent being adapted to achieve a second locking together with the locking element, when the control key no longer is actuated, or ii) the detent being adapted to achieve a locking together with the locking element, when the control key is not actuated, and the detent being adapted to be released from engagement with the locking element when the control key is actuated again, or when the control key is actuated.

2. The safety buckle device according to claim 1, wherein the detent is adapted to issue a first acoustic indication for signaling the first locking of the detent together with the locking element, and the detent is adapted to issue a second acoustic indication for signaling the second locking of the detent together with the locking element, when the control key no longer is actuated, and the detent is adapted to issue an acoustic indication when the detent is locked to the locking element.

3. The safety buckle device according to claim 1, wherein the control key is shaped as a bar, the detent is adapted to be springingly inserted into the two recesses for locking of the two buckle parts to each other, and an abutment surface is arranged in a deeper of the two recesses, the abutment surface being adapted to displace the detent sidewise when the control key is actuated so as to release the detent from the locking element.

4. The safety buckle device according to claim 1, wherein the locking element is a locking surface which is arranged in the guiding tongue.

5. The safety buckle device according to claim 1, wherein the guiding tongue includes a cut in which the detent is adapted to run when the first buckle part and the second buckle part are released from each other.

6. The safety buckle device according to claim 1, wherein the guiding tongue includes a ridge protruding in front of a front end of the guiding tongue and outwardly relative to a surface of the guiding tongue, the surface being directed toward a yoke part of the first buckle part, and the ridge being adapted to achieve an initial engagement with the yoke part of the first buckle part.

7. The safety buckle device according to claim 1, wherein the at least partially closed space of the first buckle part has a yoke part which is adapted to be inserted between the guiding tongue and a main part of the second buckle part.

8. The safety buckle device according to claim 7, wherein, in a locked position of the safety buckle device, an upper side of the yoke part of the first buckle part with associated external side edges is adapted to closely abut against an underside of the main part of the second buckle part with associated inner side edges.

9. The safety buckle device according to claim 1, wherein the detent includes a hook adapted to, when the buckle device is locked, engage with the locking element.

10. The safety buckle device according to claim 1, wherein a protruding shoulder is arranged on an inside of a yoke directed toward the at least partially closed space and adapted to fit into and cooperate with a recess arranged in a part of the guiding tongue which is directed toward a space.

11. The safety buckle device according to claim 1, wherein the detent includes a hook, the hook including a shoulder adapted to cooperate with a complementary shoulder of the locking element, at least in an initial locking position between the first and the second buckle parts.

12. The safety buckle device according to claim 1, wherein the first buckle part is attached to a front piece of a baby carrier, and the second buckle part is attached to a strap loop of the baby carrier.

13. A safety buckle device comprising:

a first buckle part including a partially closed space having an opening, and an elastically positionable detent arranged in the partially closed space; and a second buckle part including a body, a guiding tongue having a locking element, and a control key, the control key having a first recess and a second recess each having a different depth and being arranged adjacent each other in a longitudinal direction of the control key, the safety buckle device being configured such that for a locking thereof, the guiding tongue is contained in the partially closed space, and the detent locks against the locking element, with the detent effecting a first locking with the locking element upon actuation of the control key, and the detent effecting a second locking with the locking element when the control key no longer is actuated, or with the detent effecting a locking with the locking element when the control key is not actuated, and with the detent being released from the locking with the locking element when the control key is actuated again, or when the control key is actuated.

14. The safety buckle device according to claim 13, wherein the detent is elastically insertable into the first recess and the second recess to effect the locking of the first buckle part and the second buckle part, and wherein a deeper one of the first recess and the second recess has an abutment surface therein, the abutment surface being configured to displace the detent sidewise when the control key is actuated so as to release the detent from the locking element.

* * * * *